United States Patent [19]

Kuntz

[11] 4,394,037

[45] Jul. 19, 1983

[54] SPARK-GENERATING ROLLER SKATE ASSEMBLY

[76] Inventor: David H. Kuntz, 11810 Bel Ter., Los Angeles, Calif. 90049

[21] Appl. No.: 211,820

[22] Filed: Dec. 1, 1980

[51] Int. Cl.[3] ..... A63C 17/026

[52] U.S. Cl. ..... 280/816; 46/10; 46/48; 272/70; 280/11.1 R; D21/226

[58] Field of Search ..... 280/816, 809, 11.1 R, 280/11.1 BR, 11.1 BT, 11.1 ET, 11.115, 11.28, 11.3, 11.19, 11.1; 46/10, 48, 47; D21/81, 226, 227; 272/70; 273/DIG. 24

[56] References Cited

U.S. PATENT DOCUMENTS

| | | | |
|---|---|---|---|
| 617,996 | 1/1899 | Ruel | 280/11.3 X |
| 1,790,423 | 1/1931 | Hooks | 280/11.19 |
| 3,086,788 | 4/1963 | Vislocky | 280/816 |
| 3,731,928 | 5/1973 | Wolfe | 46/10 X |
| 4,286,806 | 9/1981 | Bergstein | 280/816 |

*Primary Examiner*—Joseph F. Peters, Jr.
*Assistant Examiner*—Mitchell J. Hill
*Attorney, Agent, or Firm*—Henry M. Bissell

[57] ABSTRACT

An improved roller skate assembly in either shoe skate or skate board form is provided which includes a plurality of roller wheels, a frame securing the wheels in spaced relation for rotation and one or more spark generators, each comprising an abrasive surfaced disc or the like connected to a non-load bearing surface of one of the wheels and a sparking element such as a flint or material capable of generating colored sparks releasably held by a resilient flexible holder adjacent the abrasive surface of the disc. The holder vibrates during skating, due to ground shocks transmitted to it through the frame, bringing the sparking element into intermittent contact with the abrasive to intermittently generate sparks for a spectacular unusual effect. The holder preferably includes a metal or plastic coil spring and a fitting which releasably holds the flint and can be adjusted to reposition the flint as it wears. Alternatively, the flint can be in the form of a ball, preferably rotatable and held by a bracket attached to the spring. In another embodiment, the holder includes an arm hinged at one end to the frame, depending therefrom diagonally and supported by a depending spring. The opposite end of the holder bears the fitting and flint or other sparking element. The assembly is inexpensive, durable and economical; and it produces a pleasing, exciting unusual effect when being utilized.

17 Claims, 5 Drawing Figures

SPARK-GENERATING ROLLER SKATE ASSEMBLY

BACKGROUND OF THE INVENTION

1. Field of the Invention

The present invention generally relates to skate devices and more particularly to an improved roller skate assembly which generates sparks during use.

2. Description of the Prior Art

Various types of roller skate assemblies have been devised, including shoe types attachable to or including shoes, and the roller skate board, which resembles a small surf or ski board. Roller skating is again becoming very popular in its many forms and performances thereon are becoming quite skilled, varied and difficult, such as roller disco dancing and ballet. Roller skating involves speed and exercise and conveys a general feeling of excitement. It would be desirable to be able to enhance that excitement in a simple inexpensiveway which would encourage more utilization of roller skating as a form of exercise, entertainment, as a spectacle and as a form of relaxation.

SUMMARY OF THE INVENTION

The foregoing needs have been satisfied by the improved roller skate assembly of the present invention. The assembly is substantially as set forth in the Abstract. Thus, it includes one or more means for generating sparks at the wheels or rollers to provide a spectacular visual effect. Each such spark generator includes an abrasive surface in the form of a strip, layer or disc attached to a rotatable non-ground-contacting surface of one or more of the rollers and a flexible resilient holder. The holder preferably includes a spring which releasably positions a sparking element, such as flint, adjacent each abrasive surface in such manner that during skating the road vibrations imparted to the frame are transmitted by the holder to the flint, moving it intermittently, in response to those vibrations, into and out of contact with the rotating abrasive surface to cause sparks to fly from the rollers for a spectacular effect. The particular sparking element can, if desired, be selected to provide colored sparks and the like. The holder can include a fitting to enable adjustment of the flint as it wears and to regenerate the amount of abrasive-flint contact. Further features are set forth in the following detailed description and accompanying drawings.

DESCRIPTION OF THE PREFERRED EMBODIMENTS

Figure 1:
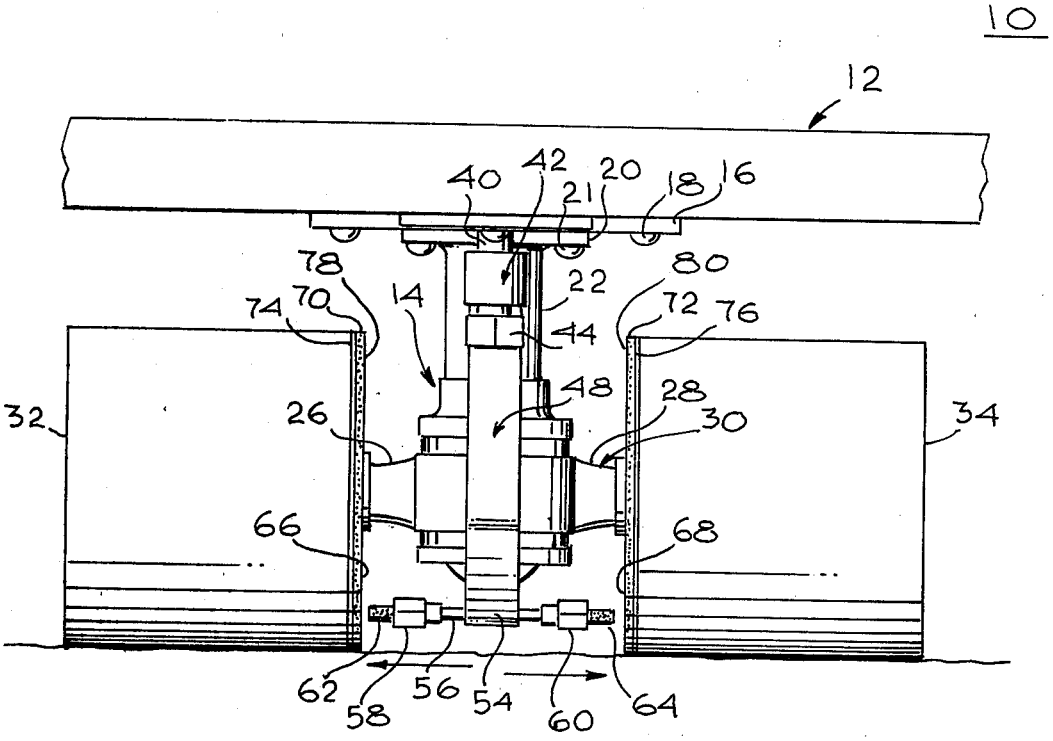
FIG. 1 is a fragmentary front elevation of a first preferred embodiment of the improved sparking roller skate assembly of the present invention, shown during skating therewith, sparks emanating therefrom.
Figure 2:
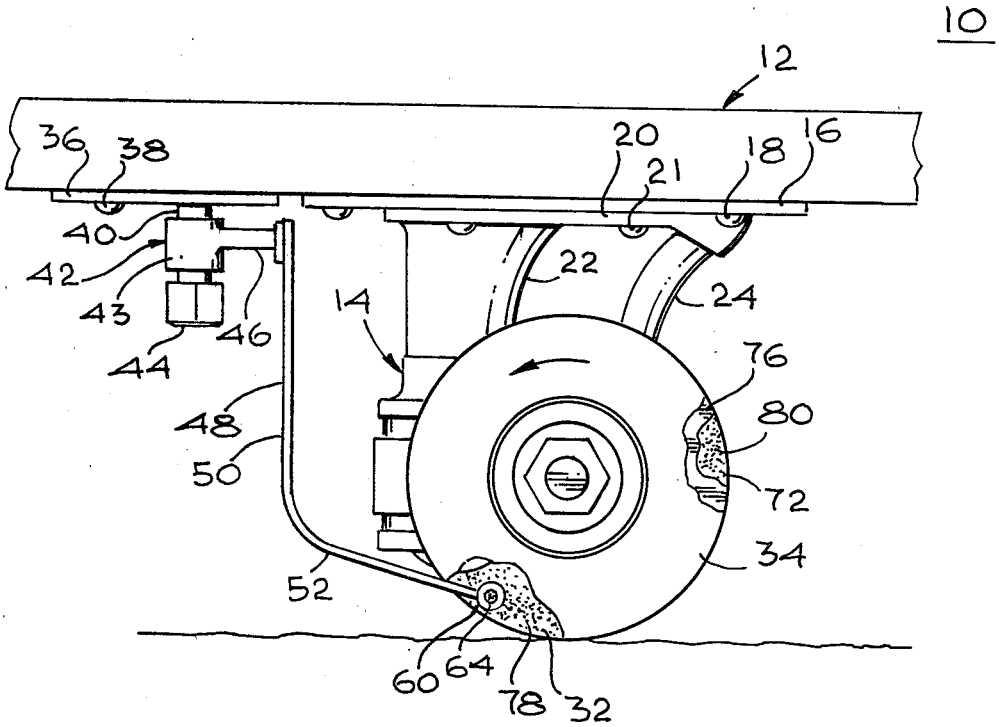
FIG. 2 is a fragmentary schematic side elevation, partly broken away, of the improved assembly of FIG. 1.

FIGS. 1 and 2

Now referring more particularly to FIGS. 1 and 2 of the drawings, a first preferred embodiment of the invention is schematically depicted therein. Thus, assembly 10 is shown which comprises a top frame 12 which may comprise the board portion of a skate board or the like. Alternatively, frame 12 could be the connecting portion of a shoe skate. A bottom frame 14 is secured to the underside of frame 12 and includes, for example, a plate 16 secured to frame 14 by screws 18, and a depending bracket 20 secured to plate 16 by screws 21 and having depending legs 22 and 24. Leg 24 terminates at its lower end in laterally extending rings 26 and 28 which form an axle 30 to which are rotatably connected a spaced pair of cylindrical rollers 32 and 34, preferably of molded rubber or plastic.

A plate 36 is secured by screw 38 to the underside of frame 12 in front of frame 14 and includes a vertically depending holder tubular leg 40. A horizontally extending bracket 42 is provided which has a front hollow ring portion 43 pivotally disposed around leg 40 and releasably secured thereto by a bottom plug or screw 44. Bracket 42 includes a rearwardly extending arm 46 to which is secured the upper end of a thin flexible resilient plastic strip 48, the upper portion 50 of which depends nearly vertically and the lower portion 52 of which is gradually curved rearwardly into an approximately horizontal plane.

Portion 52 bears at its rear end 54 a fitting 56 extending laterally horizontally between rollers 32 and 34 and releasably and adjustably securing and gripping in the hollow ends 58 and 60 thereof cylindrical flints 62 and 64. Flints 62 and 64 fit tightly into ends 58 and 60, which are internally threaded on fitting 56 for removal therefrom. Flints 62 and 64 can be repositioned or replaced in ends 58 and 60 by pushing or pulling on flints 62 and 64. Bracket 42 can be swiveled around leg 40 to also aid in positioning fints 62 and 64 relative to rollers 32 and 34. The inner opposed surfaces 66 and 68 of rollers 32 and 34, respectively, are covered by discs 70 and 72 releasably secured thereto, as by adhesive layers 74 and 76, and containing exposed abrasive surfaces 78 and 80 of sandpaper, flint paper, emery board or cloth, etc. Surfaces 78 and 80 are just out of contact with flints 62 and 64 when the latter are in their resting position, as shown.

During skating utilizing assembly 10, rollers 32 and 34 rotate and road bumps and vibrations are transmitted therethrough to frames 12 and 14 and to strip 48, causing it to vibrate in a random, intermittent manner. Flints 62 and 64 are positioned closely enough to abrasive surfaces 78 and 80 such that these intermittent movements of strip 48 bring one or the other of flints 62 and 64 intermittently into brief contact with the associated rotating abrasive surface 78 or 80, causing sparks to be generated and to fly out from assembly 10, creating a vivid effect. Certain other pyrophoric materials such as a pyrophoric alloy of metals such as iron, cobalt, etc. can be used. Certain phosphor compounds and the like as are known in the art can be added or substituted, if desired, to not only produce the described sparks but produce them in vivid colors. If it is desired at any time to eliminate the sparking effect, or to replace flints 62 and 64, plug 44 can be pulled from leg 40 and bracket 42 can be removed by slipping it from leg 40. The ends of fitting 56 can then be unscrewed to replace flints 62 and 64, if desired.

FIG. 3

Figure 3:
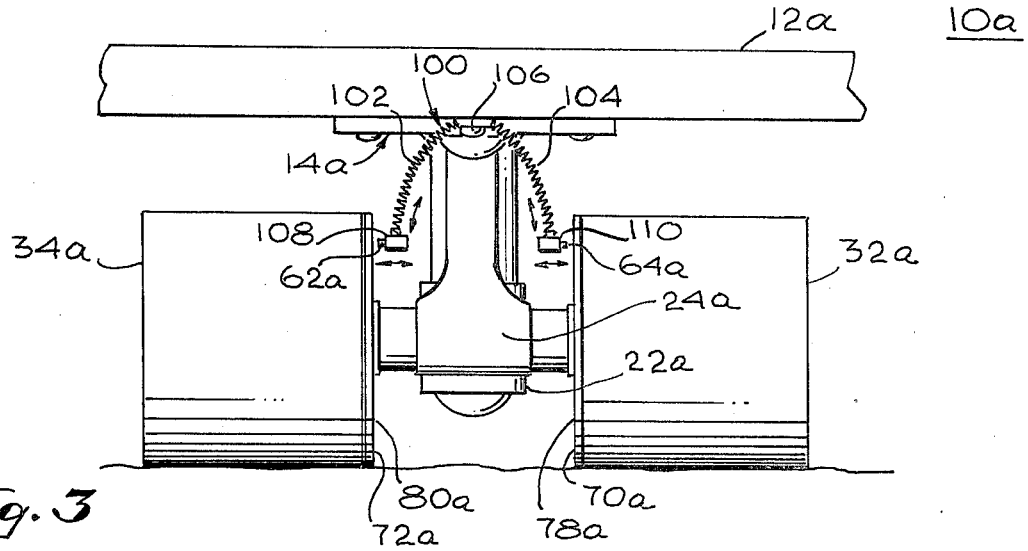
FIG. 3 is a fragmentary schematic rear elevation of a second preferred embodiment of the improved roller skate assembly of the present invention.

A second preferred embodiment of the improved roller skate assembly of the invention is schematically depicted in FIG. 3. Thus, assembly 10*a* is shown. Components thereof similar to those of assembly 10 bear the same numerals but are succeeded by the letter "a". Thus, assembly 10*a* includes frames 12*a* and 14*a*, the latter with legs 22*a* and 24*a*, rollers 32*a* and 34*a* and a spark generating unit 100. Unit 100 is behind frame 14*a* and comprises a pair of depending metal coil springs 102 and 104 secured at their supper ends by screw 106 to frame 12*a* and bearing at the lower free ends thereof transversely extending fittings 108 and 110 releasably holding flints 62*a* and 64*a* in close proximity to abrasive surfaces 78*a* and 80*a* of discs 70*a* and 72*a* affixed to the opposed inner surfaces of rollers 32*a* and 34*a*.

Assembly 10*a* operates substantially similar to assembly 10, except that since fittings 108 and 110 are independent of each other, sparks could emanate from both rollers 32*a* and 34*a* at the same time as a result of vibrations and oscillations of both springs 102 and 104 during skating of assembly 12*a* over a surface. Fittings 108 and 110 can be made adjustable and repositionable, and flints 62*a* and 64*a* which protrude through end openings thereon are replaceable therein.

FIG. 4

Figure 4:
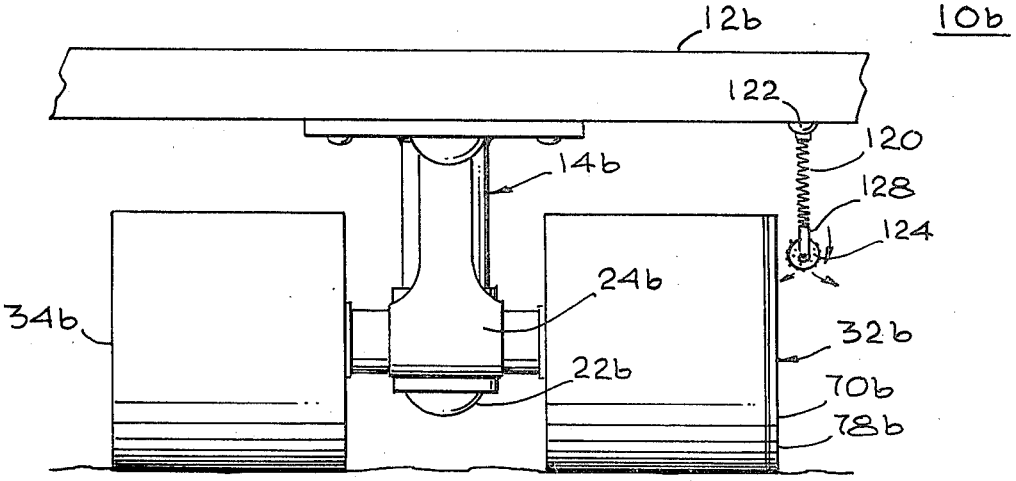
FIG. 4 is a fragmentary schematic rear elevation of a third preferred embodiment of the improved roller skate assembly of the present invention.

A third preferred embodiment of the invention is schematically depicted in FIG. 4. Components thereof similar to those of FIGS. 1 and 2 bear the same numerals but are succeeded by the letter "b". Thus, assembly 10*b* is shown which includes frames 12*b* and 14*b* (the latter with legs 22*b* and 24*b*), rollers 32*b* and 34*b*. Roller 32*b* has on the outer vertical surface thereof disc 70*b* bearing an abrasive outer surface 78*b*. A coil spring 120 is secured by a screw 122 to the underside of frame 12*b* and its lower end bears a flint-studded ball 124 rotatably connected thereto by a bracket 128. Ball 124 oscillates vertically and laterally and can rotate or be rotated to present various patterns of the flint studded surfaces to closely adjacent abrasive surface 78*b*. Otherwise, assembly 10*b* performs similarly to assembly 10.

FIG. 5

Figure 5:
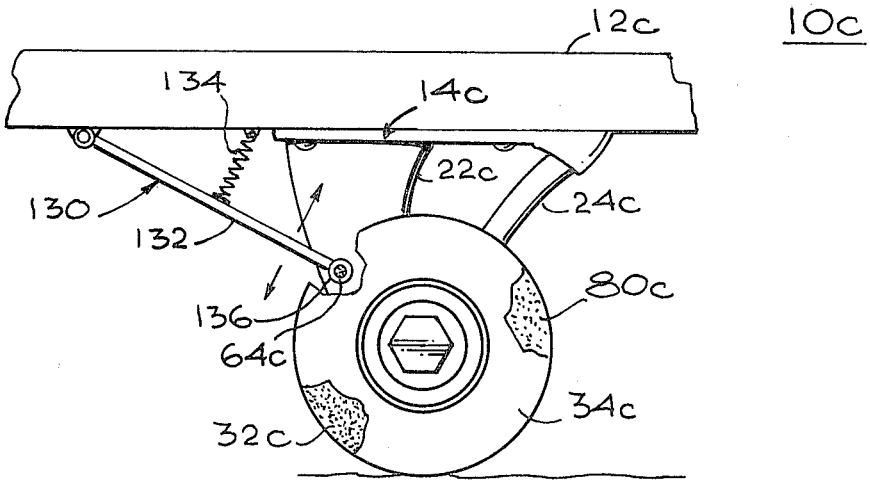
FIG. 5 is a fragmentary schematic side elevation, partly broken away, of a fourth preferred embodiment of the improved roller skate assembly of the present invention.

A fourth embodiment of the invention is schematically depicted in FIG. 5. The components thereof similar to those of assembly 10 bear the same numerals but are succeeded by the letter "c". Thus, assembly 10*c* includes frames 12*c* and 14*c* (the latter having depending legs 22*c* and 24*c*), rollers 32*c* and 34*c* and a spark generator 130.

Generator 130 comprises a rigid rod 132 hinged at one end to the underside of frame 12*c*, and depending diagonally therefrom. Rod 132 is supported by a coiled spring 134 secured to the underside of frame 12*c* and to rod 132 at about its mid-point. The free end of rod 132 is fitted with a generally laterally extending fitting 136 holding a flint 64*c* nearly against abrasive surface 80*c*. The relative angular positions or rod 130, fitting 136 and flint 64 are such that while flint 64*c* is normally out of contact with surface 80*c*, deflection of rod 132 upwardly and diagonally in response to oscillations of spring 134 brings it into contact with surface 80*c* for spark production. This occurs momentarily and intermittently during skating utilizing assembly 10*c*. A similar spark generator (not shown) can be used to accomplish the same purposes relative to roller 32*c* in assembly 10*c*.

Although there have been described above specific arrangements of an improved spark-generating roller skate assembly in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An improved spark-generating roller skate assembly, said assembly comprising, in combination:

(a) a plurality of rollers;

(b) a weight-bearing frame securing said rollers in spaced relation for rotation; and (c) a spark generator comprising:

(i) an abrasive disposed on a surface of at least one of said rollers, which surface rotates during skating utilizing said assembly but which surface does not contact the ground during said skating, (ii) a sparking element which generates a spark when moved into frictional contact with said abrasive, and (iii) a flexible resilient holder bearing said sparking element and arranged to normally position said sparking element out of contact with said abrasive but in a position close enough thereto so that vibrations imparted to said holder during skating utilizing said assembly move said sparking element into and out of brief intermittent contact with said abrasive.

2. The improved skate assembly of claim 1 wherein said abrasive is disposed on a strip releasably secured to said roller.

3. The improved skate assembly of claim 2 wherein said roller is cylindrical with vertical surfaces and wherein said strip comprises at least a portion of a disc affixed to one of said vertical surfaces.

4. The improved skate assembly of claim 3 wherein said sparking element comprises a flint.

5. The improved skate assembly of claim 3 wherein said sparking element comprises material which gives off colored sparks.

6. The improved skate assembly of claim 3 wherein said holder includes a fitting which releasably retains said sparking element.

7. The improved skate assembly of claim 6 wherein said fitting adjustably positions said sparking element relative to said abrasive.

8. The improved skate assembly of claim 7 wherein said holder includes a spring which imparts said intermittent contact.

9. The improved skate assembly of claim 8 wherein two of said rollers bear said abrasive and wherein said fitting releasably holds sparking elements at opposite ends of said fitting adjacent said abrasives.

10. The improved skate assembly of claim 7 wherein said holder comprises a depending plastic strip releasably secured to the underside of said frame and movable for repositioning said sparking elements.

11. The improved skate assembly of claim 10 wherein the lower portion of said strip curves into an approximately horizontal position adjacent the lower end of one of said rollers.

12. The improved skate assembly of claim 7 wherein said holder comprises two separate, independent springs, two of said fittings and two sparking elements, each spring holding at an end thereof one of said fittings and sparking elements, and wherein two of said rollers bear said strips adjacent separate ones of said sparking elements.

13. The improved skate assembly of claim 8 wherein said holder includes a rigid arm hingedly secured at one end thereof to the underside of said frame and bearing said fitting and sparking element at the free opposite end thereof, wherein said spring is secured to the underside of said frame and to said arm to support said arm and permit rotational oscillation thereof and wherein said arm, fitting, sparking element and spring are oriented to permit momentary intermittent contact between said sparking element and abrasive.

14. The improved skate assembly of claim 8 wherein said sparking element comprises a ball bearing pieces of sparking element on the outer surface thereof and wherein said holder includes a bracket interconnecting said ball and said spring for rotation of said ball relative to said spring.

15. The improved skate assembly of claim 1 wherein said assembly comprises a roller shoe skate.

16. The improved skate assembly of claim 1 wherein said assembly comprises a roller skate board.

17. The improved skate assembly of claim 1 wherein two of said rollers bear said abrasive and wherein said holder bears two sparking elements at opposite ends, said holder being arranged to normally position said sparking elements out of contact with at least one of said abrasives but in a position close enough thereto so that vibrations imparted to said holder during skating utilizing said assembly move said sparking elements alternatively into and out of brief intermittent contact with the respective abrasives.

* * * * *